United States Patent [19]

Larsson et al.

[11] 4,169,540

[45] Oct. 2, 1979

[54] PACKAGING CONTAINER

[75] Inventors: Lars-Göran Larsson, Malmö; Bertil S. O. Murna, Oxie, both of Sweden

[73] Assignee: Aktiebolaget Platmanufaktur, Malmo, Sweden

[21] Appl. No.: 840,100

[22] Filed: Oct. 6, 1977

Related U.S. Application Data

[63] Continuation of Ser. No. 681,231, Apr. 28, 1976, abandoned.

[51] Int. Cl.[2] ..... B65D 5/56; B65D 25/16

[52] U.S. Cl. ..... 220/462; 206/205

[58] Field of Search ..... 220/460, 462, 404, 409

[56] References Cited

U.S. PATENT DOCUMENTS

| | | | |
|---|---|---|---|
| 2,357,842 | 9/1944 | Moore | 220/460 X |
| 2,361,408 | 10/1944 | Moore | 220/460 X |
| 2,365,159 | 12/1944 | Walton et al. | 220/460 X |
| 2,374,793 | 5/1945 | Waters | 220/460 X |
| 2,438,981 | 4/1948 | Waters | 220/460 X |
| 3,029,008 | 4/1962 | Membrino | 220/460 X |
| 3,944,127 | 3/1976 | Bruke | 206/205 |

*Primary Examiner*—Davis T. Moorhead

*Attorney, Agent, or Firm*—Hane, Roberts, Spiecens & Cohen

[57] ABSTRACT

There is disclosed a package or wrapping for powderized material such as ground coffee. The package consists of a substantially rigid outer container and an inner liner or liner made of plastic or other pliable material. The goods to be packaged are placed in the inner liner, the shape of which is so that it substantially fits the container when filled. The container has on one side an opening which can be closed by a cover and the inner liner when placed in the container has on its side facing the container opening a flat closure. The liner may be secured to the container along a flange adjacent to the container opening.

6 Claims, 12 Drawing Figures

PACKAGING CONTAINER

This is a continuation of application Ser. No. 681,231 filed Apr. 28, 1976, now abandoned.

FIELD OF THE INVENTION

The present invention relates to a package of the type consisting of an outer supporting covering and a container of pliable material placed therein and intended for liquid, semi-liquid, powdered, semi-solid and solid goods.

BACKGROUND

In U.S. Pat. No. 3,944,127 issued Mar. 16, 1976 packages having a construction in accordance with the above-indicated principle are described. The aforementioned patent discloses a package which is intended for containing goods of one of the above-mentioned types under constant or increasing conditions of pressure.

Previously known packages having an inner flexible container within an outer supporting covering have their containers arranged more or less loosely in the outer containers, so that the emptying of the packages is made difficult. In cases in which the inner container was attached to the outer covering, this attachment was not provided in order to facilitate the emptying of the package. The packages described in the aformentioned patent have, in contradistinction to this, their flexible inner container and outer supporting covering, so developed and secured to each other that the emptying of the packages is facilitated. The concept of facilitated emptying includes, also, the possibility of emptying the stored goods gradually from the package and closing the package again in a simple and effective manner after each removal of the goods.

The reclosing of the packages described in the above-mentioned patent is made possible by the fact that the outer supporting covering of the package is firmly connected to the inner flexible container around the mouth of the opening. A lid of, for instance plastic, which rests tightly against the opening of the outer container, as a result of this design, also closes the inner container.

It is furthermore a characteristic feature of packages in accordance with the above-mentioned patent that the inner containers are filled before they are placed into the outer supporting coverings. In certain cases, it is, to be sure, inadvisable to make use of this method. This may be the case, for instance, when the packages are to be used for storing materials which do not retain their shape, for instance liquids, or when the manufacturer of the material which is to be stored in the packages wishes to utilize for the filling thereof the equipment which he already has and which is designed for filling containers which are already entirely complete.

SUMMARY OF THE INVENTION

The present invention refers to a package which, when filled, has the same properties as the packages described in the patent and the properties of which, upon emptying, are the same as the properties of the containers developed in accordance with the aforementioned applications, the package, however, only being filled after the inner container has been combined with the outer supporting covering.

The package may be of definitely parallelepiped shape and the one wall side may represent the mouth of the package. In this case, the inner container is fastened to the periphery of the mouth in such a manner that one of the sides of the inner container forms a lid disk at the said mouth and can easily be cut with a knife. In this connection, it is desirable for this side of the inner container preferably to have a flat surface without joints, folds, or flaps. The opening of the package is combined with a lid of plastic, for instance, which after the package has been opened seals it tightly. The shape of the mouth may vary. It may, for instance, have completely flat walls or it may be provided with an inwardly directed circumferential flange. In the latter case, it may frequently be advisable to fasten the inner container to such flange. In this way, opening the container is facilitated, particularly when this is effected by cutting the lid disk out with a knife.

It is also characteristic of the invention that the package has such an arrangement that the filling thereof is effected through a part of the package which subsequently represents the bottom of the completed, filled package. In order that the inner container have, within the assembled, closed package, a flat surface in the direction which is subsequently to correspond to the opening portion of the filled package, the inner container is folded together in a special manner. The folding will be explained in detail with reference to the drawings, which form an integral part of the present application. The inner container, after having been folded together, is introduced into the outer supporting cover and fastened to it at the part which corresponds to the mouth portion of the package upon the opening thereof. During the filling, this part, to be sure, represents the bottom of the package. When the inner container has been introduced into the outer supporting cover and fastened therein, the inner container has the shape of an open parallelepiped preferably of flat bottom, with two of its sides provided with a welded joint and flaps extending up from the preferably flat surface on each of the sides provided with joints.

Upon the filling, the package, therefore, consists of an inner container which is surrounded by an outer supporting covering and is fastened to the latter in that part of the package which serves as bottom of the package during the filling. The package is then closed in normal manner by means of a suitable method of folding, employing for instance welding or gluing. The package accordingly does not differ with respect to its method of filling and closing from other known packages and can thus be used with the filling equipment which is normally available. This, of course, is true even in cases in which the package is used for filling with materials which are intended to be kept under vacuum, for instance coffee. It is self-evident that slight adjustments may be necessary when changing to a new format or in the event of a different method of folding. The essential fact in this connection is of course that the basic equipment which is already on hand can always be used.

One advantage of the package is that a relatively cheap material can be used for the outer supporting covering, while a flexible material which is selected with reference to the physical properties required by the goods to be stored is used for the inner container. The use of expensive material is thus limited merely to the inner container.

Another advantage of the package is that the inner container and the outer supporting covering are fastened to each other so that when the package has been emptied the inner container can be easily separated from the outer covering. This facilitates recovery of the material, since different types of material can be easily separated from each other.

BRIEF DESCRIPTION OF THE DRAWING

The invention will be described in further detail with reference to the Figures shown in the drawing, in which.

DETAILED DESCRIPTION

Figure 1:
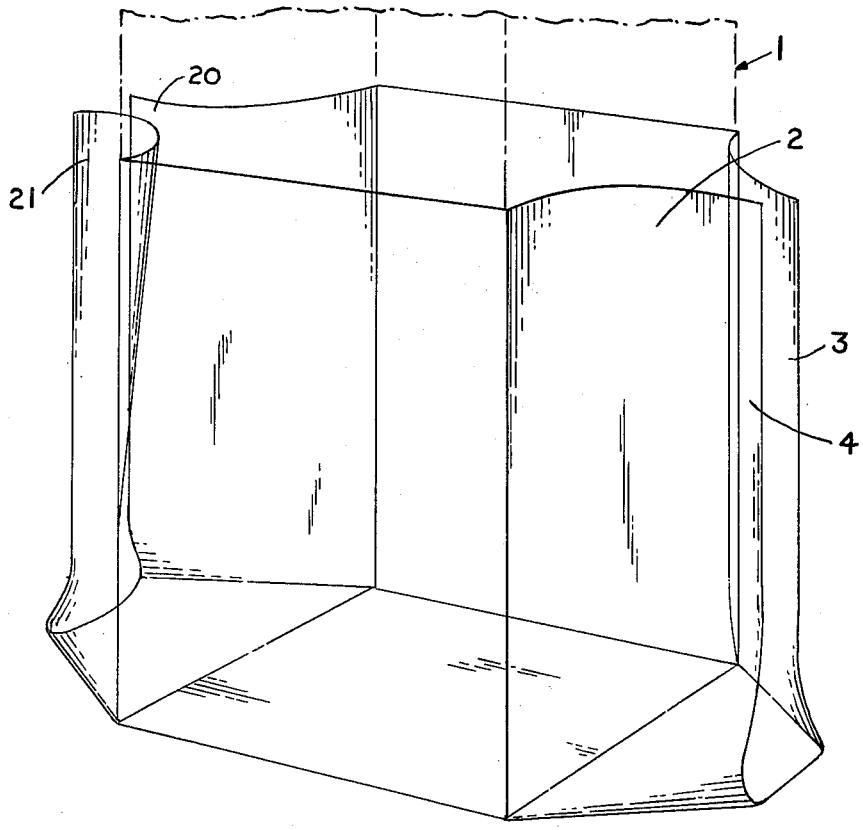
FIGS. 1 and 2 show various phases during the folding of the inner container.

In FIG. 1, there can be noted the flexible material 2, which is to be folded together to form an inner container. A punch 1 is partially surrounded by the flexible material. The flexible material can be transparent, for which reason the mandril in the Figure is not concealed by the flexible material. The dimensions and shape of the punch correspond to that of the inner packing which is being produced. The edge portions of the flexible sheet which is to be shaped to form the inner container are designated 3 and 4 and 20 and 21 respectively.

Figure 2:
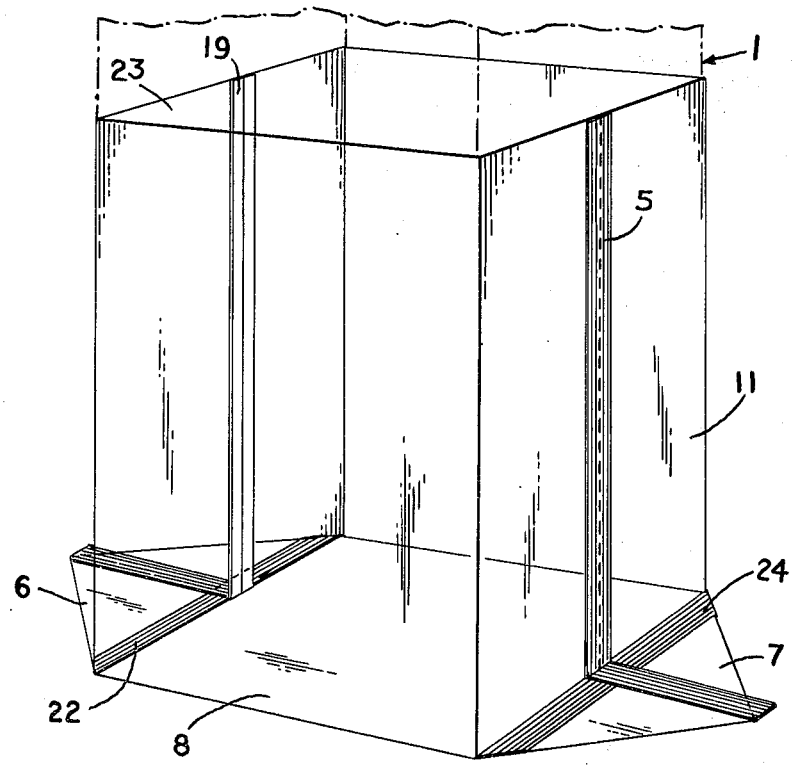
Figure 3:
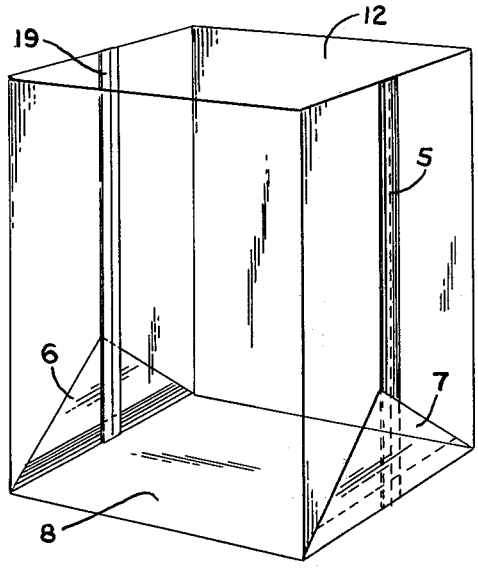
FIG. 3 shows an inner container which has been prepared for introduction into an outer supporting covering.

In FIGS. 2 and 3, the numbers 5 and 19 represent longitudinal weld or adhesive seams which connect the edge portions 3 and 4 and 20 and 21 respectively together. The side wall which contains the longitudinal welding seam 5 is marked 11 and the side wall which contains the longitudinal weld seam 19 is marked 23. In the transition between the side walls having the weld seams and the bottom part 8 of the inner container the two weld or adhesive seams 24 and 22 respectively are located. These last two weld seams connect the bottom surface with the two flaps 6 and 7. In FIG. 3 the flaps 6 and 7 have been folded upward against the corresponding side. The inner container in this Figure has the appearance which corresponds to the appearance of the container when it is connected with its outer supporting covering and is ready for the introduction of the goods into it.

Figure 4:
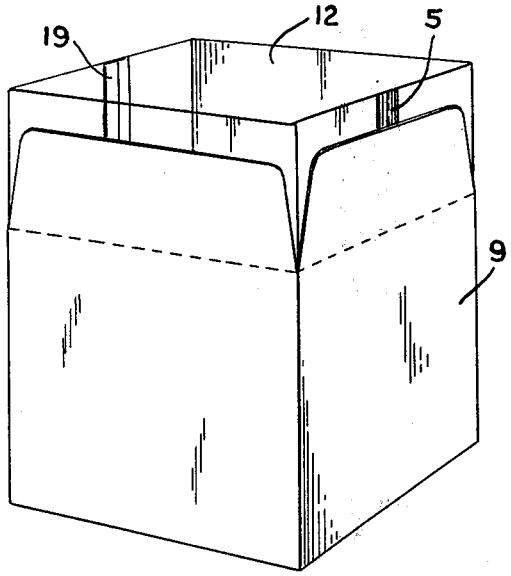
FIG. 4 shows a complete package with inner container and outer supporting covering, ready to be filled.
Figure 5:
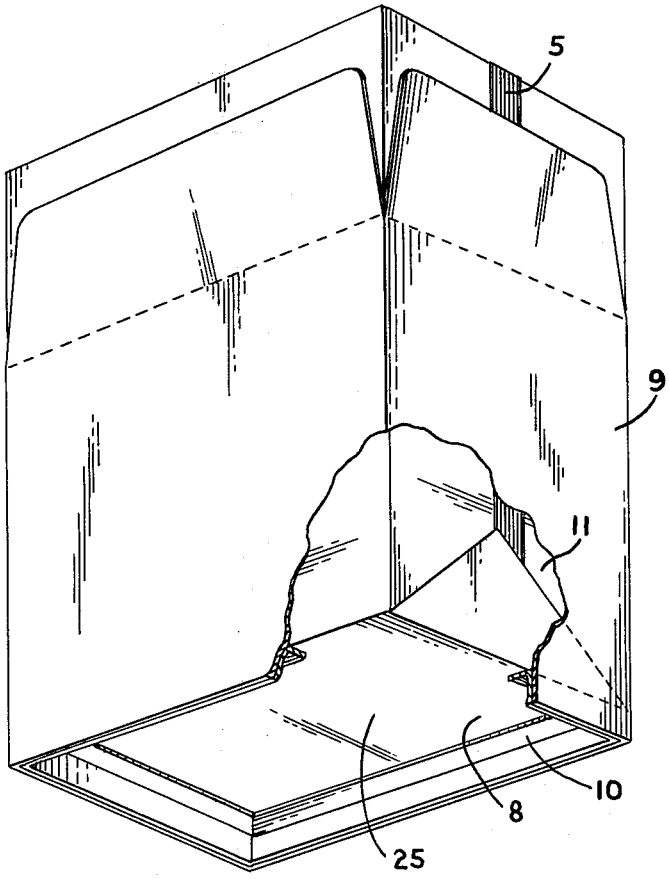
FIG. 5 shows a complete package seen from the bottom—referred to the filling opening—and with the outer covering partially cut away in order to show how the inner container is arranged in the outer covering.

In FIGS. 4 and 5 the inner container has been introduced and fastened in the outer packing. In FIG. 4 the assembled package is shown obliquely from above, while in FIG. 5 it is shown obliquely from below. In FIG. 5 the outer packing has furthermore been partially cut away. In the Figures there can be noted the outer supporting covering, which is also referred to as the outer packing 9, with the inwardly directed circumferential flange 10. The inner container is fastened to the inwardly directed circumferential flange of the outer packing adjoining the outer edges of the bottom surface 8. In the package formed in this manner the smooth bottom surface forms a flat lid disk 25 in the manner shown in FIG. 5. The filling opening 12 of the inner container is also shown.

Figure 6:
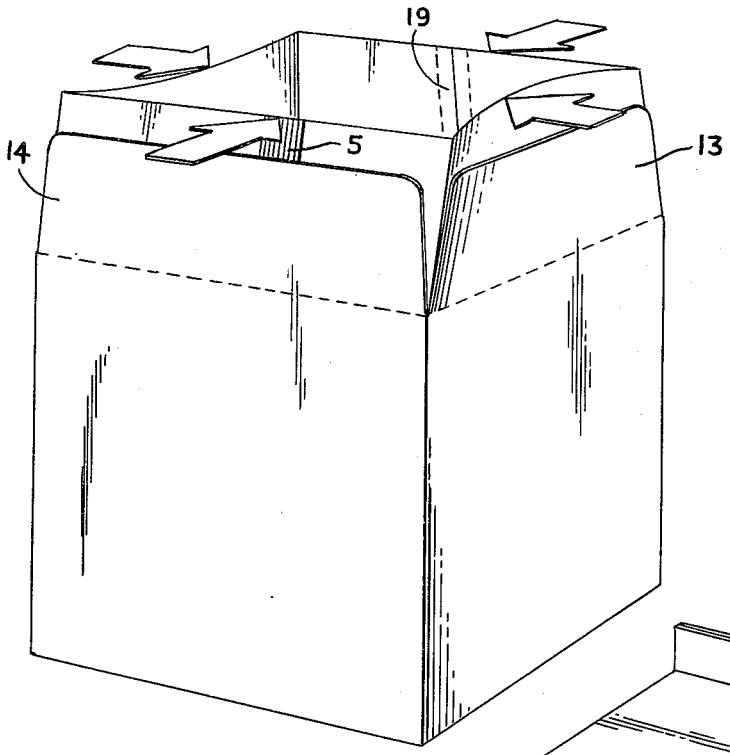
FIGS. 6 to 8 show an alternative for the enclosing of the inner container in the filling part thereof.
Figure 7:
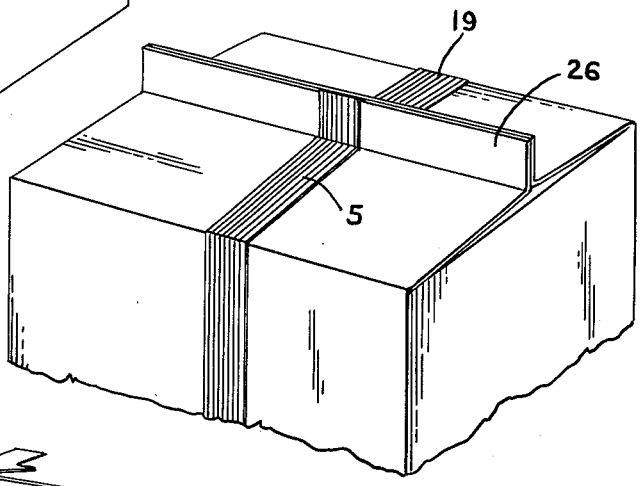
Figure 8:
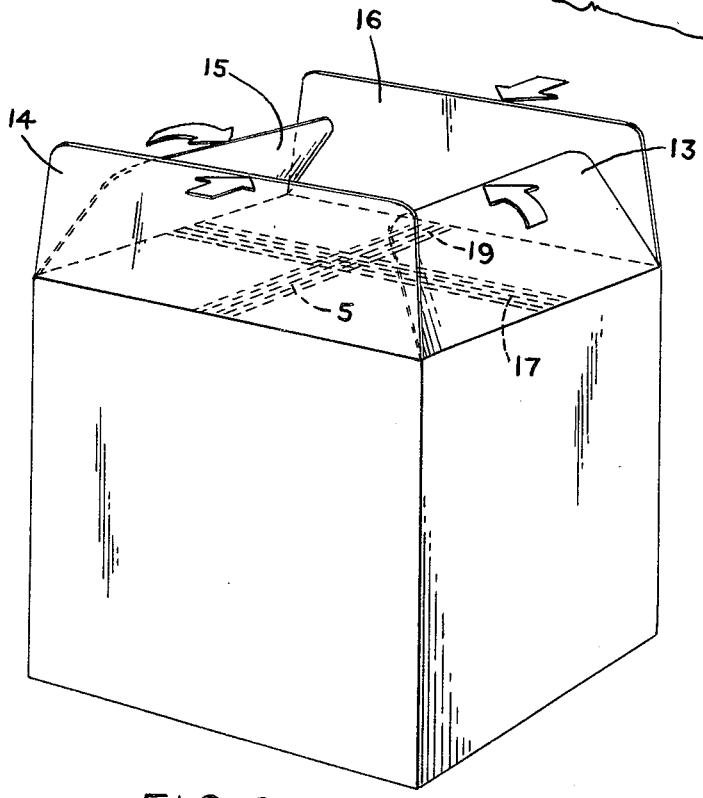
Figure 9:
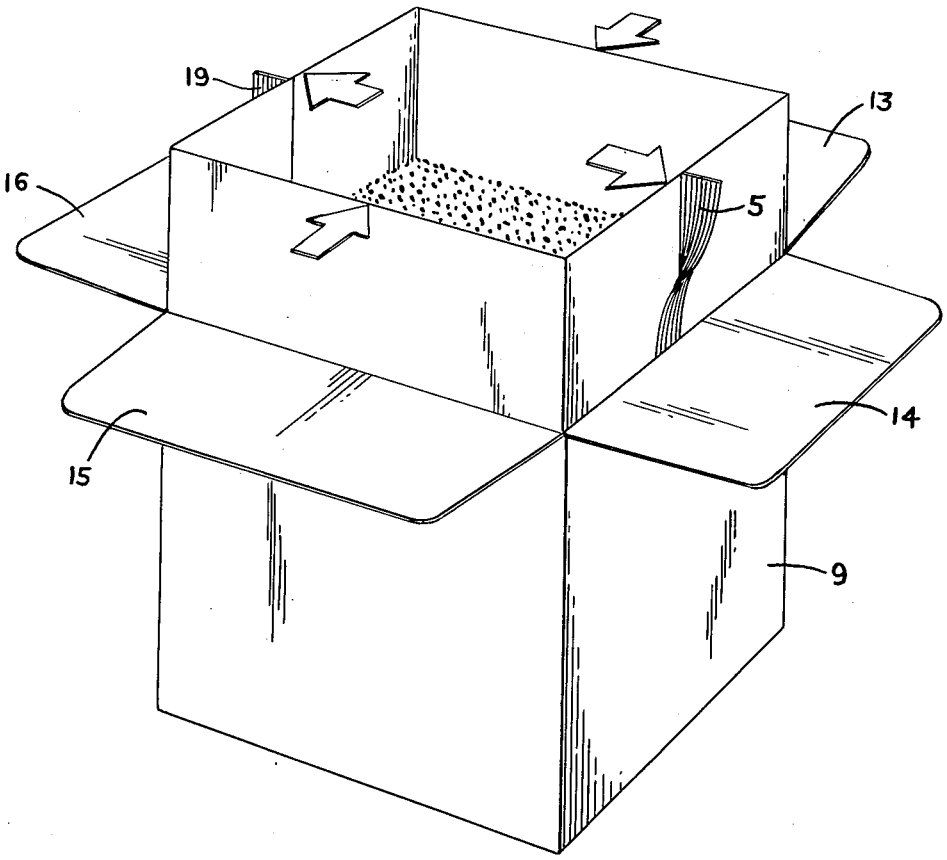
FIGS. 9 to 11 show another alternative for the closing of the inner container.
Figure 10:
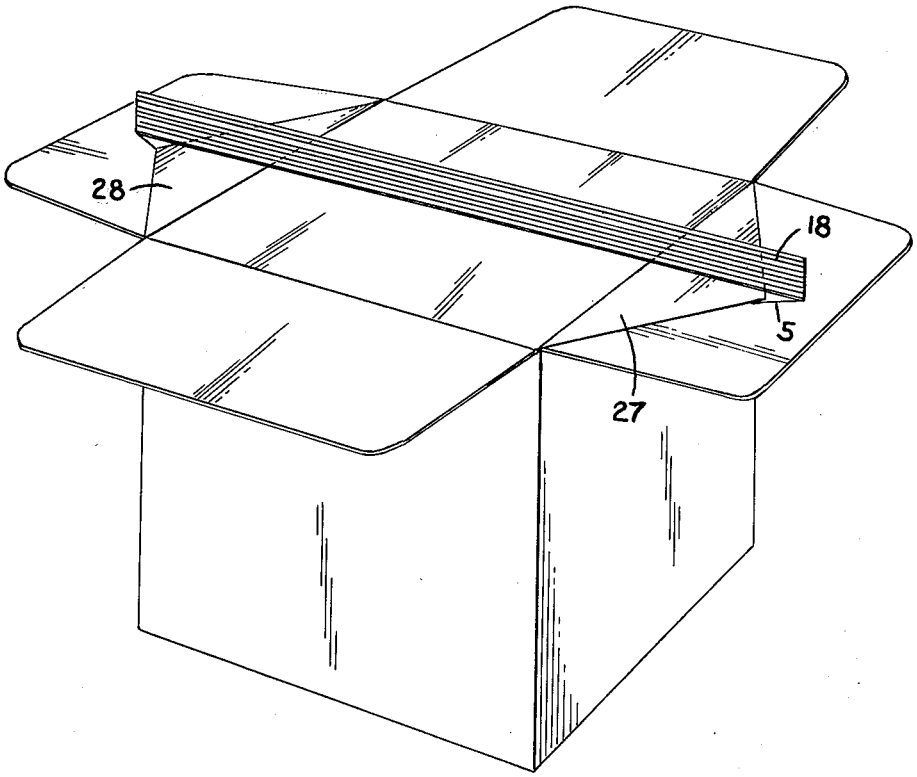
Figure 11:
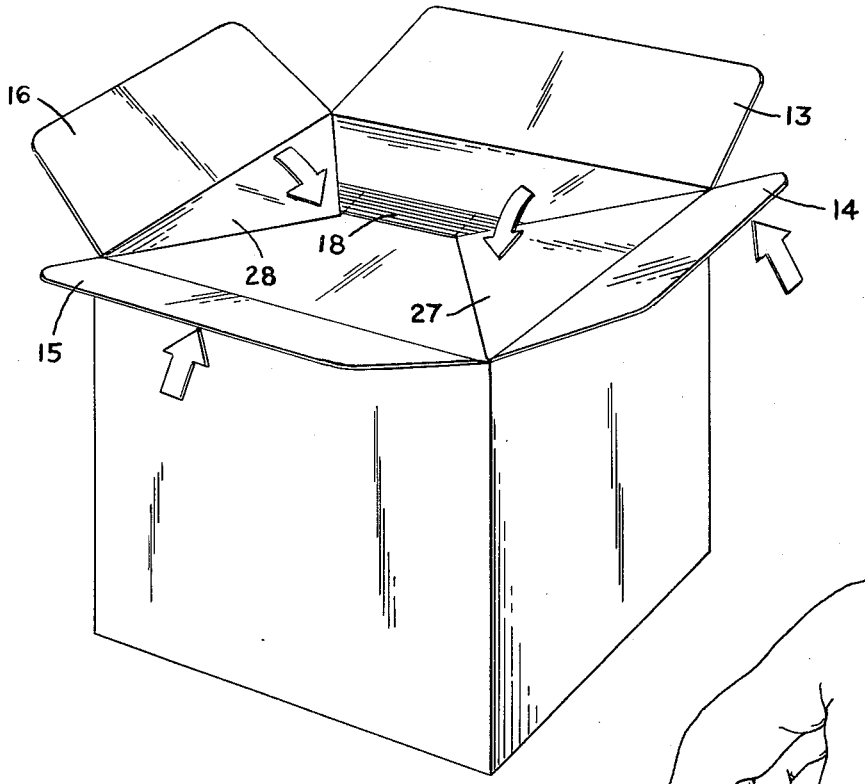

FIGS. 6 to 11 show clearly two different alternative methods of folding, for closing the inner container after the filling. FIGS. 6 to 8 show one alternative, while FIGS. 9 to 11 show the other. In accordance with both alternate method of folding, the closing of the inner container is effected by means of closure welds. In the first alternate method of folding, the weld is designated 17, while in the other alternative it is designated 18. The closure flaps of the outer packing are marked 13, 14, 15 and 16. FIG. 7 contains a detailed view of the folded opening-part of the inner package in accordance with the first method of folding. The folded opening part forms a flange-like upward directed edge 26, which is ready for fastening by welding. The flaps 23 and 28 formed upon the folding are shown in FIGS. 10 and 11.

Figure 12:
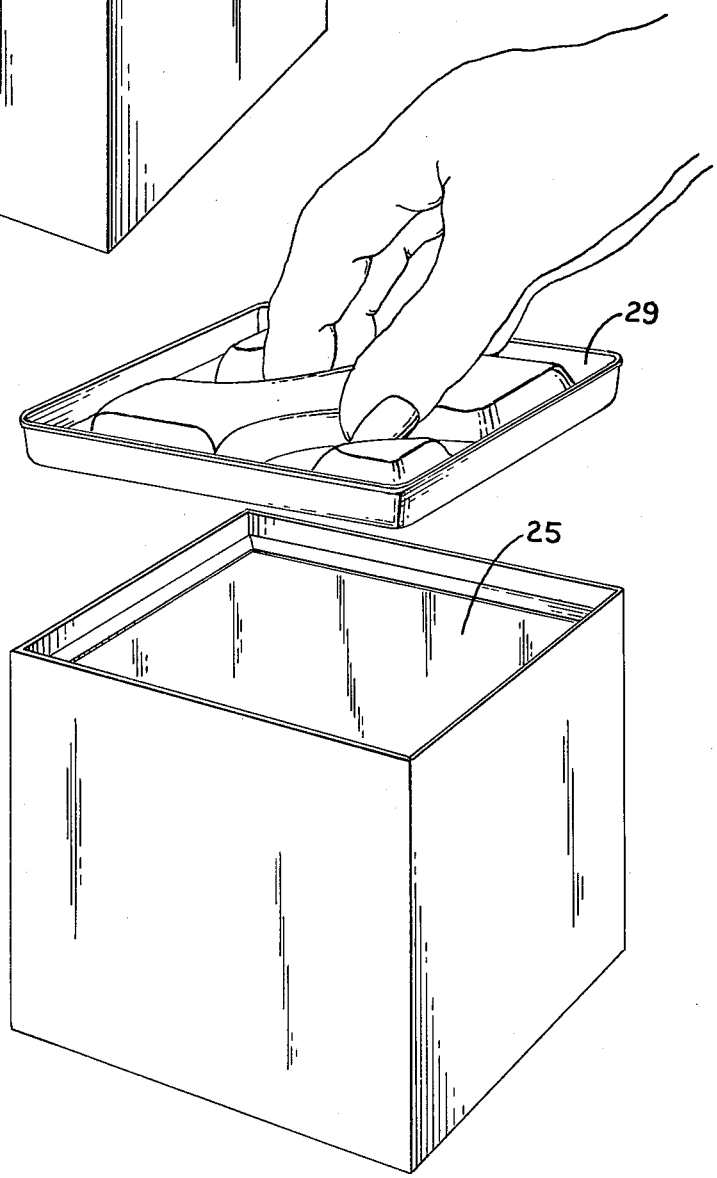
FIG. 12 shows a filled package with its lid being removed from it.

FIG. 12 shows a filled package and a reclosure lid 19. The lid of the package is shown during its removal.

In order to understand the construction of the inner container, i.e., the manner in which it is folded together, the simplest thing is to effect an imaginary folding together of an inner container. In this connection one proceeds from a sheet of flexible material 2, on which a punch 1 (mandril) is placed. The outer shape of the mandril has the shape of the inner container which is to be produced. Furthermore, the dimensions of the sheet are in accord with the size of the container to be produced. Parts of the sheet are then pulled upward on two sides of the mandril which are opposite each other and vertical in the Figure, in the manner shown in FIG. 1.

In this way a U-like bag is formed from the sheet, the bag being open on top and on both sides, said sides corresponding to the two other opposite sides of the mandril. The vertical parts of the sheet in the Figure, which protrude above the mandril are bent over towards each other so that the edge parts 3 and 4 as well as 20 and 21 meet in such a manner that strips on each side of the edge parts together form a flange which protrudes at right angles from the surface of the mandril and in such a manner that the remaining part of the inner surface of the sheet rests against side surfaces corresponding to this on the mandril. Due to the fact that a flat application is obtained for all the vertical surfaces of the inner container, a fold is obtained on each side along the transition between the vertical surface and the bottom surface of the mandril on the one hand, while, on the other hand, a flap 7 or 6 is formed which protrudes from said fold. The edge parts 3 and 4 as well as 20 and 21 are now welded to each other and the corner welds 22 and 24 are now effected in the fold, i.e., the fold which lies in the transition between the vertical surfaces of the mandril and the bottom surface, in order to stabilize the folds and thus the shape of the container. The two flaps are then swung up on either side and the inner container has the appearance shown in FIG. 3.

An inner container such as shown in FIG. 3 accordingly has a smooth bottom surface 8 which has neither folds nor welds, two vertical sides which are also entirely smooth, as well as two vertical sides on which there are present the longitudinal welds 5 and 19 on the one hand and on the other hand flaps 7 and 6 which have been swung against the sides. The sixth side of the container constitutes its filling opening 12.

In accordance with the invention, an inner container arranged in this manner is introduced into an outer supporting covering 9, in the manner shown in FIGS. 4 and 5. The smooth bottom surface of the inner container is fastened at its edges to the inwardly directed circumferential flange 10 in the outer supporting covering. The smooth bottom surface in this connection forms the flat lid 25.

A composite package developed in this manner has a filling opening for the inner container which does not differ upon its filling from known filling openings of packages. After the filling, the inner package is closed by folding the opening part and then welding. FIGS. 6 to 8 show examples of a method of folding which can be used in this connection. FIGS. 9 to 11 show an alternative method of folding.

In the first method of folding, two of the sides of the opening of the inner container are first of all moved inwards, whereupon the other two sides are also brought against each other, in the manner shown in FIG. 6. The inward-folded sides are preferably the sides which do not have a vertical weld seam. It is assumed that the inner container is filled with material of relative stable shape. By adjusting the required folding apparatus in suitable manner, the result is obtained that the folded filling part of the inner container as a whole forms a flat surface parallel to the surface of the lid disk. From this surface there extends a flange-like strip 26, in the manner shown in FIG. 7. The closing of the inner package is then effected by, for instance, welding or gluing the strip. After the flange has been attached, it is bent over against the flat surface which has been formed over the material in the package, and the inner package has then the appearance shown in FIG. 8. The flaps 13–16 of the outer packing can then be folded over each other, for instance in the manner shown in FIG. 8, and are thereupon fastened to each other. This part of the package is thus complete.

In the other folding method, which is preferable in the case of vacuum packing, two of the sides of the opening part of the inner packing are pulled apart in the manner shown in FIG. 9. In this way the opening part of the inner packing will assume the appearance shown, by way of example, in FIG. 10. The opening part of the inner packing is welded, obtaining the seal designated 18 in FIG. 10. The flaps 27 and 28 are bent over—see FIG. 11—whereupon the flaps 13–16 of the outer packing are folded over each other and fastened to each other and this part of the packing is then complete.

At this point, it should be pointed out that welding of the inner container by the alternative last described simplifies some of the problems inherent in obtaining a tight seal. Normally, in the previously known packings the folding together is effected in such a manner that one obtains a varying number of overlapping layers of wall material in the region of the joint. Upon, for instance, connection by a weld, the welding devices are thereby compelled to take up large differences in thickness in the region of the seal. This is made possible by the fact that the weld jaws yield somewhat, due to ample use of weld material, so that said material flows out everywhere, and/or by profiling the region of the weld. When welding in accordance with the second alternative of the invention, all such variations of thickness in the region of the weld are avoided, since there are no folds or double-folds of the layers of sheet to be connected. In this way demands made on the equipment which is to effect the joining are reduced and, at the same time, the possibilities of obtaining a tight connection are increased.

The opening part of the assembled package which has been closed for instance by one of the alternatives described above, thereupon forms the bottom part of the filled package. The opening part for the filled package consists of the smooth lid disk described above, together with the surrounding parts of the supporting covering. The package will in the future be used normally in the position shown in FIG. 12. A lid 29 is placed on the opening part, protecting it from damage. The lid is held in its seat on the one hand by the fact that it fits by friction in the opening of the outer cover and on the other hand by the fact that, for instance, a sealing strip is fastened over it.

Upon the opening of the package, the sealing strip is torn open, the lid is removed, and the flat lid disk is cut out. If the package is only partially emptied, it can be closed again by means of the lid 16. In this way the package is imparted properties similar to a can. However it is substantially cheaper to manufacture than previously known containers of can type.

As suitable material for use for the inner container as well as the outer covering, there may be used paper board, cardboard, plastic, metal, or the like, as well as combinations of such materials. In those cases in which the material is used for the inner container it must however be flexible, while if used for the outer supporting cover it should be stiff.

The packings described in Swedish patent application Nos. 73 126 83-1 and 73 126 84-9 refer to packings which are developed in a manner corresponding to the development of the packing in accordance with the present description. The inner container of the packings in accordance with said applications are, to be sure, filled with their material before they are placed in the outer supporting covers. Upon the filling they have a tubular shape, after which they are so closed by means of suitable members that the filled inner container has the same geometrical shape as the outer cover. The packing described in the present specification is filled after its inner container has been fastened in the outer cover. Due to the different methods of filling the packings, the packing described in the present application requires a folding together and thus a construction which differs fundamentally from the method of folding, and thus the construction of the aforementioned packings.

In the new packing described here, two of the edge flaps 6 and 7 are folded against two of the side surfaces of the inner packing. This results in a stiffening effect for both the inner packing and the combined packing. In particular the stiffening of the inner packing facilitates the handling of the package when empty. In certain uses, due to the stiffening, a thinner cardboard can be used.

One advantage of the container of the invention is that the re-closure lid does not extend out from the outer walls of the package. In this way, the space available on pallets and in containers is optimally utilized.

In cases in which foil is used for the inner container, the smooth lid disk in the opening part of the package affords the possibility of seeing the content of the package. This may constitute valuable information from the standpoint of the consumer, when considering the purchase of a given article.

The smooth lid disk in the opening part of the container can be provided with figures and writing, giving information, for instance, as to the composition of the goods, how to open the package, etc., or serving merely for decorative purposes. It can also be provided with perforations or other intended tear points, which facilitate the removal of the lid disk.

In the above description it has been stated that the inner container is to have a smooth, joint-free surface for the side walls which the inner container holds directed towards the opening part of the composite package. It is obvious that the inventive concept—namely the combining of an outer supporting cover with a flexible container arranged therein which is filled after the inner container has been fastened in the outer cover—may also comprise other foldings of the inner container. As a result of such other foldings, it may be that the opening part of the inner container no longer has a smooth joint-free surface. Such a folding of the inner container, however, means that the opening part is normally less attractive in appearance and at the same time it is made somewhat difficult to cut open the inner container.

In certain cases of use, it is desirable to facilitate the removal of the lid disk after it has been cut out from the inner container. This can be done by fastening a special grip device to said lid disk. Such a grip device may also be provided together with a perforation of the lid disk, this perforation, facilitating the cutting open of the lid disk or representing a part of an easy-opening device for the lid disk. In certain embodiments, the alternative methods of folding mentioned in the preceding paragraph can be developed in such a manner with a joint lying in the lid disk that the joint can be used as gripping device for the removal of the lid disk after it has been cut out.

In the above description, it has been assumed that the inner container is made of a separate sheet of foil which has been cut to the dimensions of the inner container. It is obvious that this sheet can also be cut to shape upon the initial part of the folding of the container. In this case, the material for the inner container is accordingly removed for instance from a roll of foil material. It is also possible for the inner container to consist of a plurality of sheets or blanks.

It has furthermore been assumed in the description that the folding of the inner container is fixed by means of a number of weld seams. Obviously these attachments can be replaced by fixing with, for instance, glue.

The invention has been described as a combination of an inner container and an outer supporting cover. It is obvious that inner containers which have been folded to shape and fixed as described above, can be used without being combined with an outer supporting cover. This is true if the containers have been made of flexible material and also when they have been made of a stiffer material.

What is claimed, is:

1. A package comprising an outer container of stiff material, and an inner container of flexible sheet material, said inner container having a shape of a parallelepiped and being positioned within the inner space of said outer container for enclosing material therein, said inner container being made of a continuous flat sheet of material and having four side walls, a top wall, and a bottom wall which define said parallelepiped shape, each of two of said four side walls opposite to one another having thereon extending the entire longitudinal length thereof a weld seam, each of said two side walls also having attached thereto a flap extending from said top wall and being folded toward said bottom wall and sealed against the respective side walls, each flap comprising a weld seam continuous with the weld of its respective side surface, said top wall being constituted by the thickness of the sheet of material of the inner container and being free from flaps and folds to form a flat smooth surface, said bottom wall comprising a plurality of flaps continuous with said four side walls and sealed together to constitute a tight seal; said outer container comprising four side walls corresponding to said four side walls of said inner container, a top wall corresponding to said top wall of said inner container, and a bottom wall corresponding to said bottom wall of said inner container, said outer container further comprising a circumferential flange positioned adjacent to and spaced from said top wall of said outer container, said circumferential flange extending inwardly from the inner walls of said four side walls of said outer container so as to overlap said top wall of said inner container, said circumferential flange also having means for securing said top wall of said inner container thereto, weld seams at the juncture between said flaps and the side walls, said weld seams extending along the width of said side walls and stabilizing the folds between the flaps and side walls and the shape of the inner container in the region of the securing of said top wall with the circumferential flange of the outer container, and a cover lid sealably fittable within the outer container for enabling the removal of the material contained in said inner container and the subsequent closing thereof, said cover lid resting in its closed position sealably on said circumferential flange, whereby upon the cutting open of said top wall of said inner container via the opening defined by said circumferential flange the filling material in said inner container may be discharged.

2. A package as claimed in claim 1 wherein said weld seams at the juncture between the flaps and side walls extend along the entire width of the side walls.

3. A package as claimed in claim 1 wherein said inner container is inserted into the outer container in inverted position so that the top wall rests on said circumferential flange whereafter the inner container is filled with material and the bottom walls of the inner and outer containers are sealed whereupon the package is inverted, said circumferential flange being recessed from the opening at the top wall of the outer container to enable filling of the inner container and insure that the entire weight of the inner container and contents will bear on the circumferential flange.

4. A package as claimed in claim 3 wherein the opposite sides of said inner container are extended to form flaps, said flaps being folded toward and engaged with each other to form a flat closure for the bottom of the inner container, each of said flaps having an upwardly directed end portion, said end portions abutting each other whereby material filling the inner liner is retained by said closure.

5. A package as claimed in claim 3 wherein said inner container has at its end adjacent to the opening in the outer container extensions foldable to form two superimposed flat layers sealing the opening of the inner container.

6. A package as claimed in claim 3 wherein said inner container comprises strips of adhesive material on the inner surface of the two opposite side walls of said inner container extending along the length thereof, the lengths of said side walls being longer than the lengths of the two other opposite side walls of the inner container so as to protrude from the said two other opposite sides, the protruding portions of said opposite side walls being folded inwardly so as to form a flat bottom wall of the inner container; an end portion of each of said folded-over side wall portions extending upwardly from said top wall in engagement with each other, said adhesive strips joining said upwardly extending end portions whereby the inner container filled with material is closed and sealed.

* * * * *